US006247677B1

(12) United States Patent
Vinet et al.

(10) Patent No.: US 6,247,677 B1
(45) Date of Patent: Jun. 19, 2001

(54) METHOD AND ARRANGEMENT FOR FORMING CONSTRUCTION PANELS AND STRUCTURES

(75) Inventors: Alexander Joseph Vinet, Hilton; Robert Radovan Sladojevic, Rostrevor, both of (AU)

(73) Assignee: A. R. Tiltform Pty. Ltd., Beverley (AU)

( * ) Notice: Subject to any disclaimer, the term of this patent is extended or adjusted under 35 U.S.C. 154(b) by 0 days.

(21) Appl. No.: 09/403,931

(22) PCT Filed: Apr. 28, 1998

(86) PCT No.: PCT/AU98/00307

§ 371 Date: Oct. 27, 1999

§ 102(e) Date: Oct. 27, 1999

(87) PCT Pub. No.: WO98/49415

PCT Pub. Date: Nov. 5, 1990

(30) Foreign Application Priority Data

Apr. 28, 1997 (AU) ..... PO 6498

(51) Int. Cl.[7] ..... E04G 17/14
(52) U.S. Cl. ..... 249/189; 52/745.09
(58) Field of Search ..... 52/741.15, 745.09, 52/742.15; 249/2, 219.1, 189; 264/33, 34

(56) References Cited

U.S. PATENT DOCUMENTS 1,244,958 * 10/1917 Colt ..... 249/189 X
2,859,503 * 11/1958 Hennig ..... 249/189 X
5,492,303 * 2/1996 Jaruzel ..... 249/189 X
5,575,938 * 11/1996 Ono ..... 249/189
5,956,922 * 9/1999 Liuska ..... 52/745.09

FOREIGN PATENT DOCUMENTS

66108 * 8/1975 (AU) ..... 52/745.09 X
6322980 * 11/1994 (JP) ..... 249/189 X

* cited by examiner

*Primary Examiner*—Peter M. Cuomo
*Assistant Examiner*—Michael J. Fisher
(74) *Attorney, Agent, or Firm*—Brown, Martin, Haller & McClain LLP

(57) ABSTRACT

Method and arrangement for casting structures using form-work is disclosed applicable but no limited to on-site casting concrete construction panels for subsequent erection. Set back from form-work location are set-back buttresses (11) fixed to the work site surface. The set-back buttresses (11) support sliding risers (25–29) which can be secured in place relative to the set-back buttresses (11) and released and moved to and from the form-work location. The sliding risers (25–29) support form-work at the form-work location. A plurality of sliding risers (25–29) can be supported by the set-back buttresses (11) one above the other. In this way side-forms can be supported for structures of complex vertical profiles; for example, convex or concave walls, steps and stacks of construction panels may be moulded. Also disclosed are reusable side-forms which are supported by the sliding risers (25–29) and can be used as form work for construction panels. The side-forms can be butted together end to end and also end to face thereby continuous rectangular moulds can be made.

21 Claims, 12 Drawing Sheets

METHOD AND ARRANGEMENT FOR FORMING CONSTRUCTION PANELS AND STRUCTURES

BACKGROUND OF THE INVENTION

The invention disclosed herein relates to form-work. The invention is applicable to producing constructions using form-work from concrete and other curable non solid materials. In particular but without intending to limit the scope of the invention the invention herein is directed to the construction industry and applicable to forming constructs from concrete. The construction industry and forming concrete constructions will be used to illustrate the invention herein but it will be appreciated that this is for explanatory purposes only.

In the construction industry it is often desired to form a construct by erecting temporary form-work and pouring concrete within the form-work. Once the concrete has cured or set the form-work is removed. Structures such as walls, curbs, suspended slabs, ramps and stairs are examples of structures poured in situ.

Other structures, including buildings, are made of large concrete panels. These panels can be manufactured off site and transported to a building site or alternatively such panels can be poured on-site and once set raised and located in position.

Structures such as stairs can be made from concrete poured into a specifically built form-work. Typically, timber and plywood are used to make the form-work. The form-work is held together with nails and braced into place. It can take a significant length of time to build the form-work. Once the form-work has been used it is removed and most is discarded. Accordingly, there is the expense of materials and labor in constructing the form-work. Further the work-site can become littered with off-cuts of timber and nails posing a hazard to workmen.

In the manufacture of rectangular concrete construction panels there are a number of techniques used in the construction industry for this purposes. Such panels can be made on-site or off-site.

Panels made off-site should be made with at least two sets of lifting anchors. One set for loading onto a delivery vehicle and another for unloading and erecting in place. This is because most manufacturers of such anchors will guarantee their anchors for a single lifting operation. Since this requires extra anchors and transportation of heavy items panels are often made on-site. Off-site made panels are typically manufactured more accurately in terms of dimensional accuracy, conformity and squareness than on-site made panels.

In most on-site panel manufacturing process a number of panels are made in a stack of typically four or six panels each lying horizontal one on top of the other. These stacks are typically manufactured on a concrete work-site surface or floor. Each panel is poured in sequence. Once cured the panel is coated with a substance, commonly called Bond Breaker, to prevent subsequent concrete adhesion. Then a further panel is poured and the process repeated as desired. When ready each panel is lifted and erected vertically in place.

A first known system for panel manufacture is the shutter system. This system relies on pre-fabricated shutters made from typically plywood sheets and a timber frame to hold the sheets together. The shutters and frame are typically pre-fabricated on-site requiring cutting of sheets and timber, and nailing together the frame and shutters. Each sheet is nailed to a timber frame which typically goes about the perimeter of the sheet with intervening support timbers. The shutters are constructed high enough to accommodate manufacturing a stack of panels typically up to six high.

The panel size is marked out on the concrete work-site floor. The base of the frame of each shutter is fixed to the work-site floor by drilling holes, using concrete anchors, and bolting the frame to the floor. The shutters are then plumbed and fixed in place by nailing timber braces to the frame and to timber brace plates which are fixed using concrete anchors to the work-site floor.

Once the shutters or form-work is erected the desired panel thicknesses are marked on the form-work face. Then fillets are nailed to the form-work face at these thicknesses to mold a chambered panel edge. The accuracy of the panel thicknesses is dependant upon the accuracy of the marking out process. This process is subject to human error in reading a tape measure or a dumpy level and transposing the desired marks to the form-work sides.

Compounding the mentioned problems of inaccuracy of panel thickness is the nature in which concrete needs to be worked. The poured concrete needs to be screed. Generally form-work is made so that its topmost edge is the desired level of the concrete. Then the screeding tool is run along the edge of the form-work thereby working the concrete to the desired level. With the shutter system all but the last panel must be screed to a line rather than an edge which is for more difficult to achieve and often leads to variation is panel thickness.

Once the form work is constructed reinforcing rods and mesh are set up within the form-work as required by the panels. Since the form-work is that required for a full stack this means that installing the reinforcing rods and mesh is hindered by the form-work. Care must be used not to damage the form-work or injury to a workman as the reinforcement is carried over the edge of the form-work.

The pouring and working of concrete leads to lateral pressures being experienced by the form-work. This is especially so when a machine is used to vibrate and compact the concrete in place. As the timber bracing typically is temporary and inexpensive it will often move under the lateral pressures thereby moving out of plumb. Once a stack is out of plumb it is impossible or at least very difficult to re-plumb form-work without dismantling the form-work and re-assembling. Even when the form-work is dismantled and re-assembled it is very difficult to correctly set up the form-work plumb and square. The effect of the form-work being out of plumb is to change the dimensions of the panel including thickness.

It will be clear from the above that the shutter system is very labor intensive. The form-work is bulky, heavy and requires large quantities of materials. Further, the panel forming operation is hampered by the form-work.

Another known system is the timber edge board system. In this system timber boards or planks are used on edge to act as the side-form. The width of the timber planks are the same as the intended thickness of the panel.

Upon a concrete work-site surface the intended panel dimensions are marked out. Then timber supports are made and set out. The supports typically include a timber base, a timber riser and a brace between the riser and the base. The join between base and riser is generally strengthened by use of a steel angle plate nailed to the base and riser. The support is set back from the marked panel so that the riser is the thickness of the planks from the marked panel. In this position the support are fixed to the concrete surface by use of concrete anchors and bolts.

A number of supports are positioned about the marked out panel. Then planks are cut and nailed together to form the side-form of the panel. These joined planks are nailed to the risers of the supports and the whole frame work plumbed and squared. Fillet edges are nailed to the inside face of the side-form planks. Then the reinforcing rods and mesh are installed and the concrete poured and screed. Once the concrete is cured another set of side-form planks are fixed to the risers sitting on edge on the top edge of the planks of the first set of planks. The new side-form is plumbed and squared and the next panel is manufactured. The process is repeated until the desired number of panels in the stack is reached.

It will be appreciated that this system does not require the side-forms, the planks, to be of width to form many panels. Rather the width of the plank is that of the desired panel thickness. This permits the poured concrete to be conveniently screed to the top edge of the side-form excepting in the proximity of the risers. About the risers great care is needed not to damage the risers supporting the side-form. Also, the problems associated with transporting the reinforcing metal work into the form-work are much less than shutter system.

As each panel has its own side-form planks it is possible to level, plumb and square the form-work for each panel. In this manner the problems associated with lateral forces on the side-forms can be corrected. This process does however take some time and skill.

It will be appreciated from the above that each panel has its own side-forms which remain in situ until the stack is dismantled and the panels erected. Consequently the system is expensive in terms of requiring many side-form planks.

Given the need to minimize cost and also to provide flexibility and convenience of working, the planks are of rough sawn timber. Rough sawn timber is supplied in nominal sizes with a significant tolerance in dimensions. The width and thickness of such planks can vary by a few millimeters. This variation is transferred to the manufactured panels but is typically increased. For example, a rectangular panel manufactured using timber side-forms typically varying by up to 5 mm (0.2 in) can lead, since there are two parallel side-forms, to a panel varying in width by 10 mm (0.4 in) from that of the intended width.

Added to the above problem, is the effect weather and work-site environment can have on the timber plank. Such a plank can shrink, swell, twist or warp compounding the problems mentioned above.

A further problem associated with rough sawn timber, planed timber being uneconomic, is that it has a pronounced timber grain. This grain is molded into the concrete surface of the panel edges. Where visible, such as around a window, further work and materials are required to hide the grain imprinted surface.

A further known system is the TILT-FAST system. This system utilizes square cross-section, tubular steel frames which are stacked horizontally one on top of another to form a riser and buttress. The cross-sectional height of a frame is that of the desired panel thickness.

The frames are laid out on a concrete work-site surface and fixed thereto using concrete anchors. To the panel facing side of the frame of each riser is affixed horizontally on edge a plywood plank of width equal to that of the height of the frame. The plywood planks are affixed using a pin and wedge system. By using a level on the face of the plywood plank which becomes the side-form together with the pin and wedge fixing system the side-form can be plumbed. Once the side-forms are plumbed fillets are nailed in place at the top and bottom edges. Then the concrete can be poured and the panel screed and formed.

When the panel is cured the frames are unbolted from the work-surface and the side-forms pulled away from the panel. A frame is re-bolted in each riser position and another frame is secured on top of each frame so that each riser comprises two frames. The plywood planks, without the fillets, are re-secured to the upper most frame of each riser and re-plumbed. Then the fillets are re-nailed and the next panel is manufactured. This process is repeated until the desired number of panels in the stack is reached.

The required re-alignment of the frames after they are dismantled to permit removal of the side-form is a time consuming process. It can also damage the anchorage of the concrete anchor holding the frame to the floor.

The process of constantly nailing, de-nailing and re-nailing the fillets is time consuming and labor intensive. Further, the plywood plank are quickly damaged beyond usefulness.

Though the system uses relatively small and light components there are many of the components. There are all the frames, the wedges and the pins which must be arranged, aligned and fixed correctly otherwise variation in panel dimensions can result. Therefore the system is slow and requires care to use which has an associated labor cost.

The nature of the frames limits the system to use for manufacture of standardised panel thickness. Currently, the known standard sizes are 125 mm, 150 mm and 175 mm. Each panel thickness requires another set of frames. Further, the side-forms are known to be typically composed of 2.4 m (7.87 ft) lengths of 25 mm (1 in) thick plywood which requires joints for panels of dimension greater than that.

This system has a further problem associated with it that the other systems need not suffer from should a dumpy level or a laser level be used to layout the fillet lines. This problem is that the frames are fixed to the floor. Therefore should the floor not be level, which is the likely situation, then each panel will be twisted or distorted rather than rectangular in cross section through out its length as is desired.

SUMMARY OF THE INVENTION

It is an object of this invention to provide an arrangement of and a method for forming form-work which will obviate or minimize at least one of the aforementioned problems, or at least provide the public with a useful choice.

The invention may be said to reside, not necessarily in the broadest or only form, in a form-work support arrangement including a sliding riser for supporting a side-form at a form-work location, a set-back buttress for fixing to a work-site surface at a position set back from the form-work location and for securably supporting the sliding riser for slidable movement in a first plane transverse to the form-work location secured there for supporting the side-form and slidable movement in the first plane away from the form-work location for unsupporting the side-form. In some applications the work-site surface is typically a concrete slab and masonry anchors and bolts are used to fix the set-back buttress in place. In other applications other forms of fixing may be used including but not limited to stakes driven into the ground to hold the set-back buttress in place.

In one form the set-back buttress substantially resists movement of the sliding riser in planes other than the first plane. Whilst this is preferred it is not essential. By limiting the available movement of the sliding risers construction of the set-back buttress is simplified. It also generally simplifies use of the arrangement. However, should it be desired greater freedom of movement for the sliding risers may be provided but this is believed to complicate the necessary securing means used to selectively secure the sliding risers in relationship to a set-back buttress and form-work. Obviously, the sliding risers can generally only support the form-work when they are secured relative to the set-back buttress which is fixed relative to the work-site.

According to one form, the set-back buttress supports a plurality of independent sliding risers one above the other. In some applications a single sliding riser is supported by a set-back buttress but in other applications such as multi-panel stack constructions or steps construction a set-back buttress supports a plurality of sliding risers.

In an alternative form the invention may be said to reside, not necessarily in the broadest or only form, in a form-work arrangement including:

at least one sliding riser for supporting a side-form at a form-work location;

at least one set-back buttress comprising:

an anchor plate fixable to a work-site surface, the anchor plate for supporting the set-back buttress on the work-site surface at a position set back from the form-work location;

a riser support frame projecting upwardly from the anchor plate when the anchor plate is bearing against the work-site surface, the riser support frame supporting at least one of the sliding risers for slidable movement transverse to and from the form-work location in a first plane, and riser support frame substantially resisting movement of the sliding risers in planes other than the first plane; and locking means for selectively securing the sliding riser or risers in a fixed configuration with respect to the riser support frame and to selectively permit the sliding riser or risers to be moved relative to the riser support frame; and, thereby each sliding riser can be moved and secured to support the side-form at the form-work location and released and moved away from the side-form.

Typically but not intentionally limiting the invention the structure being manufactured is of concrete. With the set-back buttresses spaced from the form-work and no need for the sliding risers to be proud of the topmost edge of the form-work screeding is facilitated by the lack of hindering projections.

In a preferred form there is at least one side-form for placement at the form-work location to form form-work supported in place by sliding risers secured by the locking means. It will be appreciated that the size and shape of the side-form or forms is dependant upon the nature of the structure being manufactured. For example, panels can be formed using relatively narrow elongate side-forms and a wall can be formed using a wide side-form. Further, use of multiple sliding risers one above the other permits the side-form to have a complex profile which can be used to form constructions such as stairs, concave or convex walls, and ramps.

In one preferred form the set-back buttress or each set-back buttress includes means acting between the set-back buttress and the work-site surface to substantially level the anchor plate. In this manner each set-back buttress is leveled and plumbed so permitting the riser support frame to support the sliding risers in predetermined relationship relative to each set-back buttress.

In a preferred arrangement for manufacturing panels the sliding risers are elongate and substantially rectangular in shape with a thickness small compared to a width, the sliding risers being substantially the same width as a width of the side-form, and the side-forms and the sliding risers being used on edge. The side-forms being the same height as the thickness of the panel facilitates screeding the concrete.

In another preferred form the set-back buttress or each set-back buttress includes means acting between the set-back buttress and a one of the sliding risers to substantially level and adjust the relative position of the sliding riser with respect to the set-back buttress. In this manner all the sliding risers can be plumbed and leveled relative to the same horizontal plane.

In another alternative form there is provided a form-work arrangement for on-site molding of concrete construction panels, the arrangement including a plurality of sliding risers, a plurality of side-forms, and a plurality of set-back buttresses, each set-back buttress comprising:

an anchor plate fixable to a work-site surface, the anchor plate for supporting the set-back buttress on the work-site surface at a position set back from a form-work location;

a riser support frame projecting upwardly from the anchor plate when the anchor plate is bearing against the work-site surface, the riser support frame supporting one or more of the sliding risers for slidable movement transverse to and from the form-work location in a first plane, and riser support frame substantially resisting movement of the sliding risers in planes other than the first plane; locking means for selectively secure the sliding riser or risers in a fixed configuration with respect to the riser support frame and to selectively permit the sliding riser or risers to be moved relative to the riser support frame; and, each side-form being respectively transversely securable to an end of at least one of the sliding risers, and supportable in position of form-work:

According to one form, the arrangement is one for on-site molding of a multiple layer stack of separate concrete construction panels where each panel is molded one on top of another, the arrangement being one wherein for each layer the sliding risers and the side-forms each have a vertical dimension substantially the same as the thickness of a panel to be molded at that layer, and that the sliding risers of subsequent layers of a set-back buttress are supported within the riser frame by the sliding risers of preceding layers.

In one form, the side-forms for each layer are abuttable firstly end to end and secondly end to form work face thereby continuous form work periphery can be made using the side-forms.

In the case of panel manufacturing the panels can be made without great variation in thickness or warp or twist in the panels. As previously-mentioned, a concrete work-site floor is very unlikely to be truly level as this is very difficult to achieve in practice. Combined with a large panel size to be made, without a means to ensure all sliding risers are at the same horizontal plane floor unevenness can lead to warped or twisted panels. By adjusting the height of the sliding risers at each set-back buttress so that all are on the same plane only the first panel may be significantly effected by floor unevenness, it being recalled that screeding a relatively small panel compared to a large floor is much easier to accurately accomplish. The lowest panel in a stack may be used in a location where any imperfections are not of concern or a thin discardable bed, to fill any floor unevenness can be first laid on which subsequent panels are made.

In one preferred form each side-form has two integral fillets along its length either side and aligned with the edges of its width. In preference at least one of the side-forms has an end of configuration adapted to permit that side-form to be butted against the other side-form to thereby produce a continuous form-work.

Alternatively the invention may be said to reside, again not necessarily in the broadest or only form, in a method of making structures from curable non solid material including the steps of:

i. marking out the structure on a work-site surface where form-work is to be constructed;

ii. marking out off-set buttress locations at predetermined centers and distances from the marked out structure;

iii. securing a plurality of off-set buttresses to the work-site surface such that a sliding riser supported by an off-set buttress can move to and from the marked out form-work location;

iv. leveling and plumbing the off-set buttresses;

v. inserting at least one sliding riser into each off-set buttress;

vi. covering the work-site surface upon which the structure is to be formed with release means to substantially prevent adherence of the curable non solid material to the work-site surface;

vii. placing side-forms along the marked sides of the structure;

viii. sliding the sliding risers from the off-set buttresses to the side-forms and affixing the side-forms to the sliding risers;

ix. operating locking means to lock the sliding risers in place relative to the off-set buttress;

x. installing reinforcing material within the form-work;

xi. manufacturing the structure;

xii. once the structure has sufficiently cured, releasing the locking means;

xiii. unfixing the side-forms from the sliding risers and sliding back the sliding riser away from the structure; and, xiv. pulling away the side-form from the structure.

In one preferred form, the method is used to make structures being construction panels including the further steps of:

i. setting up means to determine a level plane and adjusting sliding riser adjustment and leveling means so that the sliding risers are all level and within the same plane;

ii. placing side-forms along the marked sides of the structure each with an end abutting a form-work face of an adjoining side-form;

iii. once the last poured panel has cured sufficiently, unfixing the side-forms from the affixed sliding risers and sliding back those sliding risers away from the panel;

iv. pulling away the side-form from the panel;

v. reforming the side-form above the last poured panel;

vi. sliding to the side-forms sliding risers and fixing the side-forms to the sliding risers;

vii. covering the uppermost surface of the last poured panel with release means to substantially prevent adherence of the curable non solid material to the uppermost surface; and, viii. repeating the process until a total stack of panels is formed.

DESCRIPTION OF THE DRAWINGS

To assist in the understanding of the invention preferred embodiments will now be described with reference to the accompanying drawings.

Figure 1:
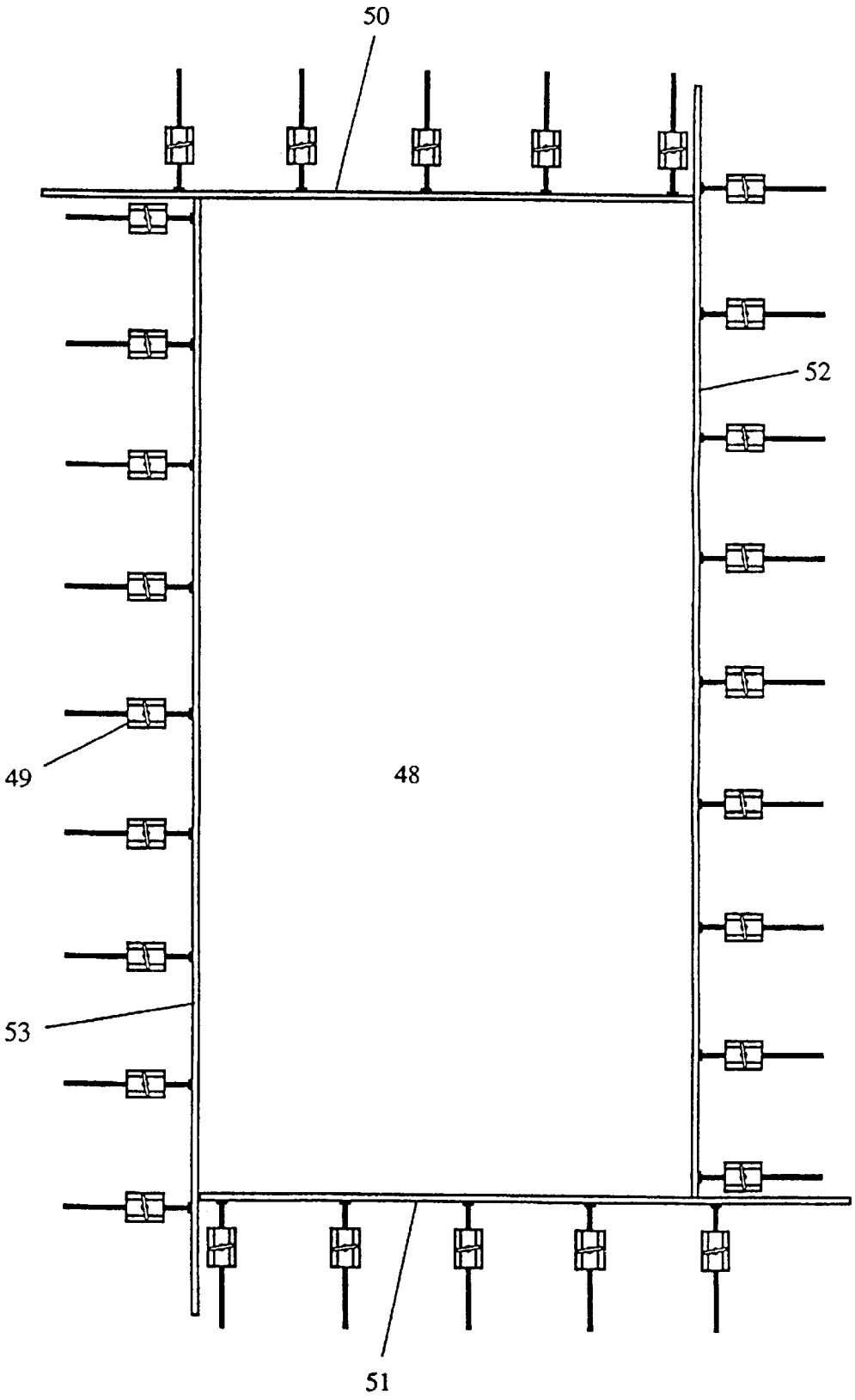
FIG. 1 illustrates a plan view of a panel manufacturing arrangement.

Throughout the Figures the same reference numeral is used to refer to the same feature. It will be appreciated the at the intent of the Figures is to illustrate the concepts of the invention . As a result the illustrations may not be to scale and features may have been omitted to aid understanding of the invention.

DETAILED DESCRIPTION OF THE ILLUSTRATED EMBODIMENTS

The arrangement includes a number of component parts including set-back buttresses, sliding risers and side-forms. These parts will be described first before the overall arrangement is described. It will be appreciated that the particular parts used depend to some extent on the application. Without intending to limit the invention the parts described will be suited to construction panel manufacture but their use or modification to other application will be apparent to a person skilled in the art.

Each side-form (1) is supplied in a limited number of standard lengths and widths. As will become more apparent hereafter the arrangement of set-back buttresses and sliding risers removes the need for the fillets to be removed after each panel is manufactured. All leveling and plumbing of the side-form is done by leveling and positioning the sliding risers. The sliding risers have an end which is butted against the side-form which is square to the leveling edge of the sliding riser.

Further, without the repeated and unavoidable damaging of plywood or timber due to nailing and de-nailing of fillets the side-form riser has a very much longer useful life. The side-form riser can be reused for many times and need not be regarded as a consumable item but rather as a tool. Consequently it is economic to make the standard sized side-forms out of materials such as aluminium or steel or plastics. Other materials can be used as desired though some of the following advantages may not be fully exploited.

Materials such as aluminium or plastics, though initial costing more than plywood previously used, are stronger so permitting the sliding risers and set-back buttresses to be spaced at greater centers. Further, climatic effects are not so great on the side-forms; warping, twisting and water damage are not experienced. With only minimal care and maintenance the side-forms can be used over a long period of time without appreciably effecting the quality of the panels formed. Also when panels of standard size are being manufactured there is no need for timber cutting and nailing tools. There are no timber off cuts, or danger from nails projecting from discarded timber or the like. Further, the number of tools required is minimal and their use is relatively straight forward and easy so permitting the quicker preparation and erection of form-work.

The side-form (1) illustrated in FIGS. 1 to 14 is made from 150×50×3 mm (6×2×0.12 in) aluminium tube which forms the form-work or edge-form (2). Aluminium triangular fillets (3 and 4) along the top and bottom edges of the form-work face are integral with the edge-form (2). The fillets are screwed to the edge-form but could be integrally formed with the edge-form when the tube is extruded. At each end, such as at end (6), of the side-form (1) the two fillets (3 and 4) and the edge-form are angled as at (7 and 8) so that the end (6) can be butted neatly up against the form-work face of another side-form (9).

The set-back buttress (10) is for making up to six panels in a stack. The set-back buttress can be made of a number of materials including aluminium and steel. This embodiment utilizes steel. At the base of the set-back buttress is an anchor plate (11) of approximately 280×130×10 mm(11.2×5.2×0.4 in).

Rising from the anchor plate is a sliding riser frame (12). This consists of four buttress legs (13, 14, 15 and 16) welded to the anchor plate each made of 25×25×3 mm (1×1×0.12 in) angle. The buttress legs are about 950 mm (38 in) long. This length permits the stacking of six sliding risers 150 mm (6 in) wide.

The buttress legs are set in spaced apart pairs to form a channel (17) approximately 200 mm long and 19 mm wide (8 in long and 0.76 in wide). It is into this channel that the sliding risers fit neatly and slide within as indicated by arrow (18). The buttress legs substantially prevent movement of a sliding riser transverse to arrow (18).

Atop the sliding riser frame is a web (19) which is welded to the ends of the buttress legs. The web (19) is 75×200×10 mm (3×8×0.4 in). At its center is a hole (20) which is aligned with a 18 mm (0.72 in) nut welded to the web. The hole (20) provides a clearance fit for a locking bolt (21) with a T handle (22) to facilitate hand tightening. At the other end of the locking bolt is a locking plate (23) residing within the channel- The locking bolt, locking plate and the nut form a locking means which bears against the top edge of sliding riser (24) which is the top sliding riser of the stack of sliding risers (24, 25, 26, 27, 28 and 29). The locking means is selectively operated to form a compression lock for the sliding risers between the locking plate and the anchor plate.

The anchor plate has a central hole (14) which provides a clearance fit for a 18 mm 18 mm (0.72 in) anchor bolt (31). This bolt is used to secure the set-back buttress to a concrete work-site surface (32) by use of a 18 mm (0.72 in) masonry or concrete anchor (33).

Figure 3:
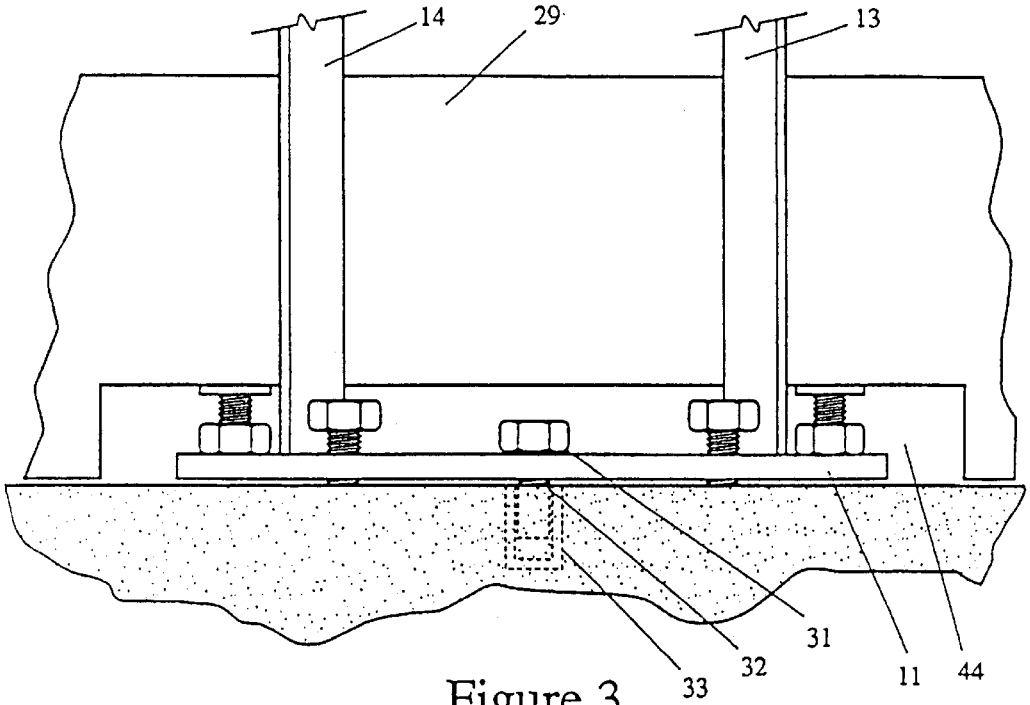
FIG. 3 is a sketch of the cross sectional plan view of a set-back buttress base.
Figure 4:
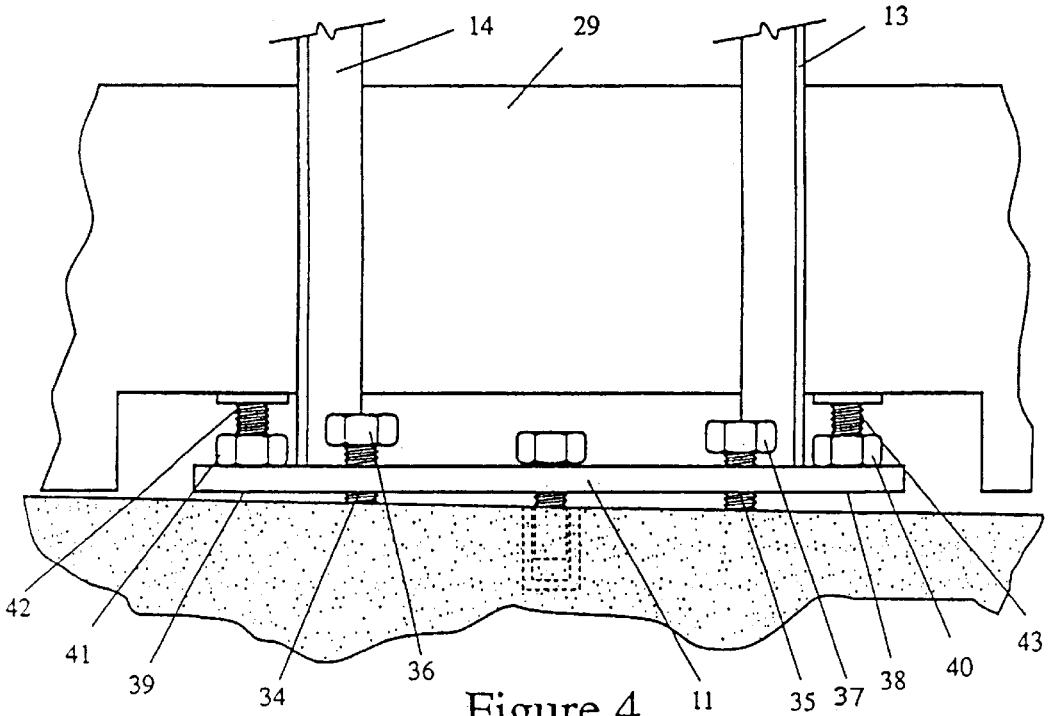
FIG. 4 is a sketch similar to FIG. 3 showing leveling of the set-back buttress relative to an inclined work-site surface.
Figure 5:
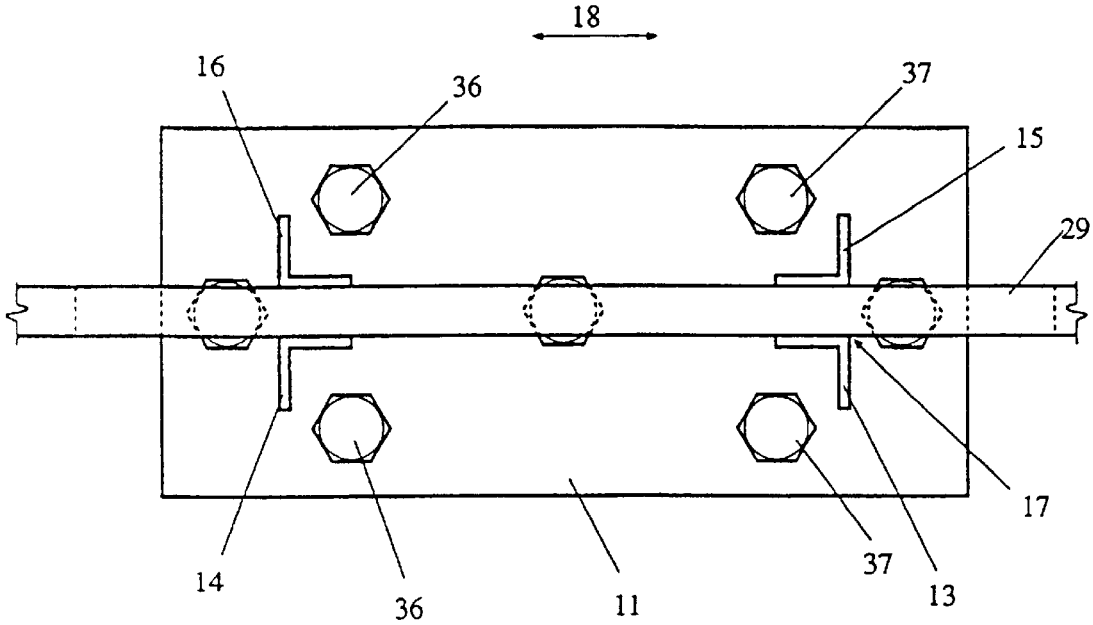
FIG. 5 is a sketch of the side view of a set-back buttress base.
Figure 6:
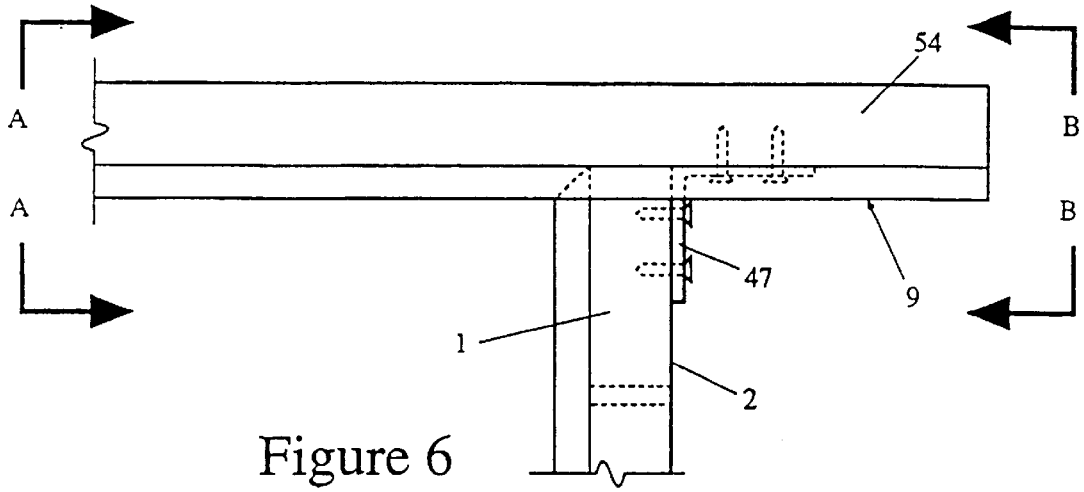
FIG. 6 is a sketch of the plane view of a corner formed between two side-forms.
Figure 7:
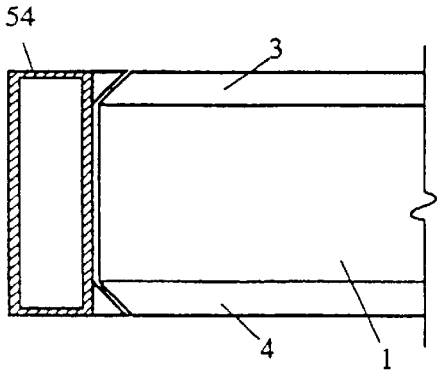
FIG. 7 is a sketch of the side view from A—A in FIG. 6.
Figure 8:
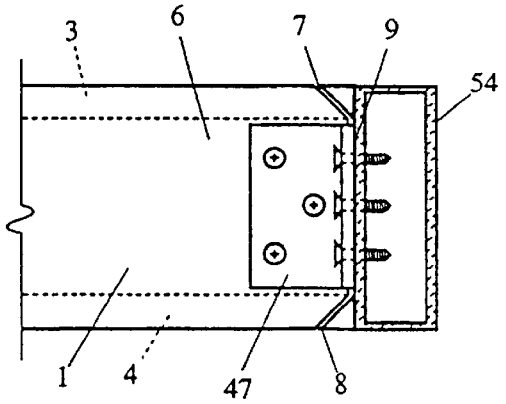
FIG. 8 is a sketch of the side view from B—B in FIG. 7.
Figure 9:
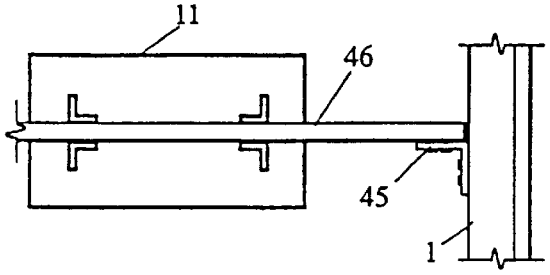
FIG. 9 is a sketch of the side view of a sliding riser, side-form and set-back riser.
Figure 10:
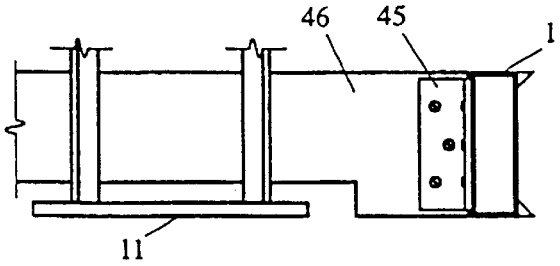
FIG. 10 is a sketch of the plan view of the arrangement illustrated in FIG. 9.

Either side of the channel are two pair of threaded 18 mm (0.72 ) holes (34 and 35). These are used with buttress leveling bolts (36 and 37) to leveled the set-back buttress. Using a spirit level the anchor plate is leveled in line with and transverse to the channel. Then the anchor bolt is tightened to secure the set-back buttress. FIGS. 3 and 4 illustrate this where bolts (37) extend below the anchor plate (31) further than bolts (36). It will be also understood that differing adjustment between bolts of each pair of bolts (36 or 37) can level the anchor plate transverse to that effected by adjustment of bolts of differing pairs of bolts.

In line with the channel but at opposite ends of the anchor plate are a pair of clearance holes (38 and 39). Aligned with these are welded 18 mm (0.72 in) nuts (40 and 41) which co-operated with 18 mm (0.72 in) bolts to form sliding riser leveling and adjusting legs (42 and 43). A sliding riser, such as sliding riser (29) rests upon the sliding riser leveling and adjusting legs.

By adjusting the legs the sliding riser (29) can be moved relative to the anchor plate and leveled by use of a spirit level. When combined with a dumpy level or a laser level which permits a horizontal plane to be determined the lowest sliding riser of each set-back buttress can be moved using the sliding riser leveling and adjusting legs to be at the same horizontal plane. This permits irregularities in the work-site surface to be accommodated.

The sliding risers are made of plywood. Each is approximately 1000 mm long and 150×18 mm (40 in long and 6×0.72 in). The lowest sliding riser of each set-back buttress, such as sliding riser (29), has a cut-out (44) to provide clearance for the anchor plate and sliding riser leveling and adjusting legs. Upper sliding risers need not have this cut-out but can if desired. All the sliding risers are manufactured to have ends square with the edges of the sliding risers.

Along the rear face of the side-forms at predetermined centers are 50×50×3 mm (2×2×0.12 in) steel angles, such as (45), each 150 mm long. These are fixed to the side-form by screws. Sliding risers, such as (46) are abutted to the side-form and fixed by screws to the side-form.

Also along the rear face are threaded holes. Along the form-work face at predetermined centers are countersunk threaded holes. These holes on the front and rear faces permit a 100 mm (4 in) angle bracket (47) to be fixed to the form-work face of the side-form as will be explained below. When not in use the front holes can have screws within them to provide a flush face.

Figure 14:
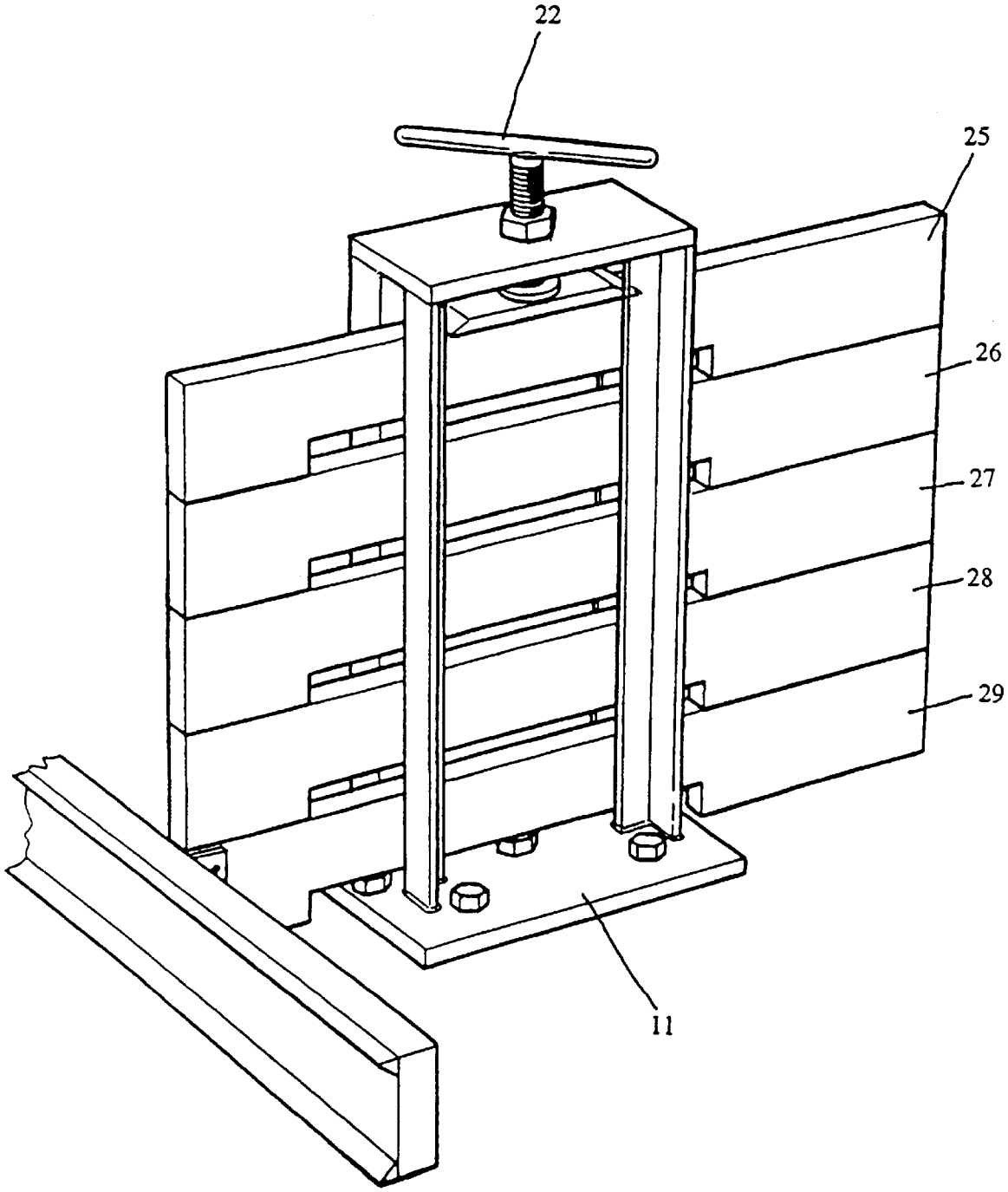
FIG. 14 is a perspective sketch showing a set-back buttress, sliding risers and side-form.

FIG. 14 provides a perspective view of the set-back buttress with five sliding risers. For simplicity the same numerical references are used here as in FIG. 2. In this case the sliding risers extend the same distance from the sliding riser frame but in many applications the upper sliding risers extend less towards the side-form than the lower sliding risers.

A plan view of the general arrangement for manufacturing a stack of six panels 8 m×4 m×150 mm (26.25 ft×18.12 ft×6) is illustrated in FIG. 1. On to a concrete work-site surface (48) is marked out desired panel dimensions, the location of the form-work and the positions of the of the set-back buttresses. The set-back buttresses (one marked as 49) are spaced from the desired form-work location by 250 mm (8 in) and are located about the panel form-work location at 1 m (3.28 ft) centers. The 1 m (3.28 ft) centers is convenient in this practical example but the centers can be increased. Typically 1.5 m centers can be used. Two end side-forms (50 and 51) of 5 m (16.4 ft) length and two side-forms (52 and 53) of 9 m (29.53 ft) length, all of 150 mm (6) width, are used to form the complete form-work structure.

The set-back buttresses are leveled and anchored to the concrete surface. The orientation of each channel of the set-back buttresses are substantially normal to the proximal form-work. Then using a laser level or a dumpy level the lowest sliding risers are adjusted in height relative to respective anchor plates so that the top edge is within the horizontal plane indicated by the dumpy or laser level.

The side-forms (50, 51, 52 and 53) are roughly set up along the marked form-work location. Each side-form abuts another as illustrated in more detail by side-forms (1 and 54). These are fixed together by use of screws and a 50×50×3 (2×2×0.12 in) angle bracket (47) 100 mm long. The screws are screwed into the previously mentioned holes in the rear of side-form (1) and the front of side-form (54). It will be noted that the angle is located outside of the form-work. In this manner the side-forms (50, 51, 52 and 53) are secured together.

The lowest sliding risers are slid towards the side-forms (50, 51, 52 and 53) and affixed thereto by use of the previously mentioned angle brackets as illustrated by angle (45) and sliding riser (46). Other sliding risers are slid into the sliding riser frame of each set-back buttress so that each of the locking means can be locked thereby securing the sliding risers in place. These extra sliding risers are kept away from the side-forms. The form-work is check and the sliding risers adjusted until the form-work is square and correctly positioned. This it will be appreciated is a straight forward task.

Having set up the form-work reinforcing work can be installed, bond breaker applied and concrete poured. Concrete is poured and screed to the top of the side-forms. Since the set-back buttresses and other sliding risers are spaced from the side-forms there is nothing to hinder screeding or vibrating of the concrete.

Once the concrete has sufficiently cured the locking means is released, the sliding risers unattached from the side-forms and slid back. The side-forms are unsecured so that the individual side-forms can be pulled away from the panel. Then the lower sliding risers are pushed forward to abut against the panel edges. Next the side-forms are roughly set in place for the next panel resting upon the lower sliding risers.

The above steps for preparing the form-work are repeated. The next panel is poured and the process repeated until the total stack is formed.

The predetermined centers of the angle brackets are selected to suit standard panel sizes. However, should a non standard panel size need to be manufactured then timber can be cut and fixed along and to the side-forms using the holes previously mentioned. Then angles can be used to secure the timbers of differing side-forms together. In this manner the side-forms need not be drilled and threaded for odd sized panels.

Within the limits of the sliding riser frames panels of differing thickness can be made within a single stack. For a different thickness panel sliding risers and side-forms of appropriate widths are used.

It will also be appreciated that should non-standard thickness panels be required then timber or plywood sliding risers and side-forms with timber fillets can be made of appropriate widths.

The above description was for concrete rectilinear panel construction. It will be appreciated that panels of other planar shapes can be formed with suitable modification and adjustment. In particular, the corners between side-forms can be suitable filled to form sufficiently smooth form-work. This can be done using inserts of suitable profile or where the angle of the corner is not a standard angle then a moldable curable filler such as a caulking compound or the like can be used between side-forms.

Figure 2:
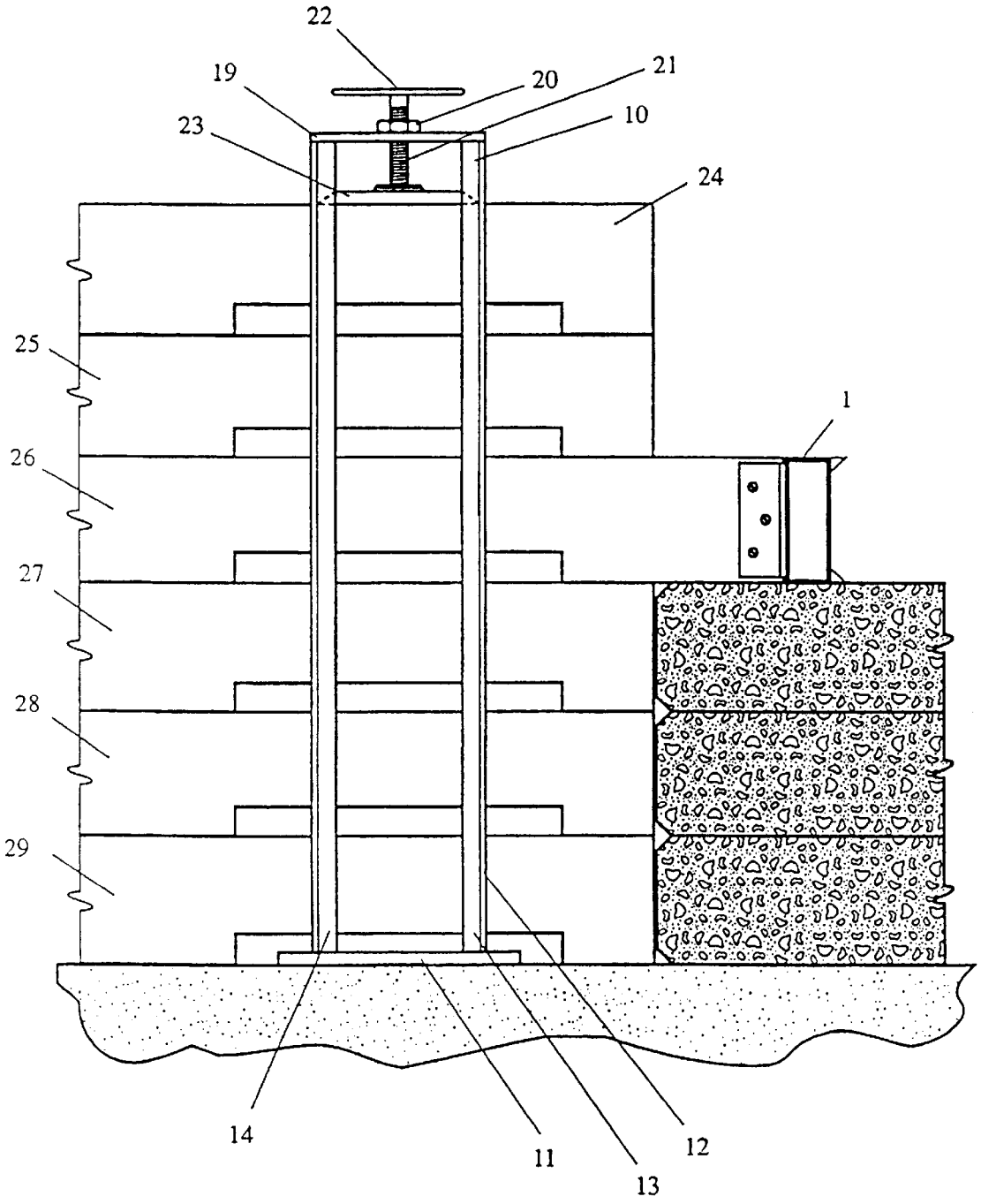
FIG. 2 is a sketch of a side view of a panel.

The arrangement can be used to make panels of different sizes within a stack. Since the panels are made separately the sliding risers of a higher panel within a stack can be extended further into the center of the form-work space. This is illustrated in FIG. 2.

Figure 11:
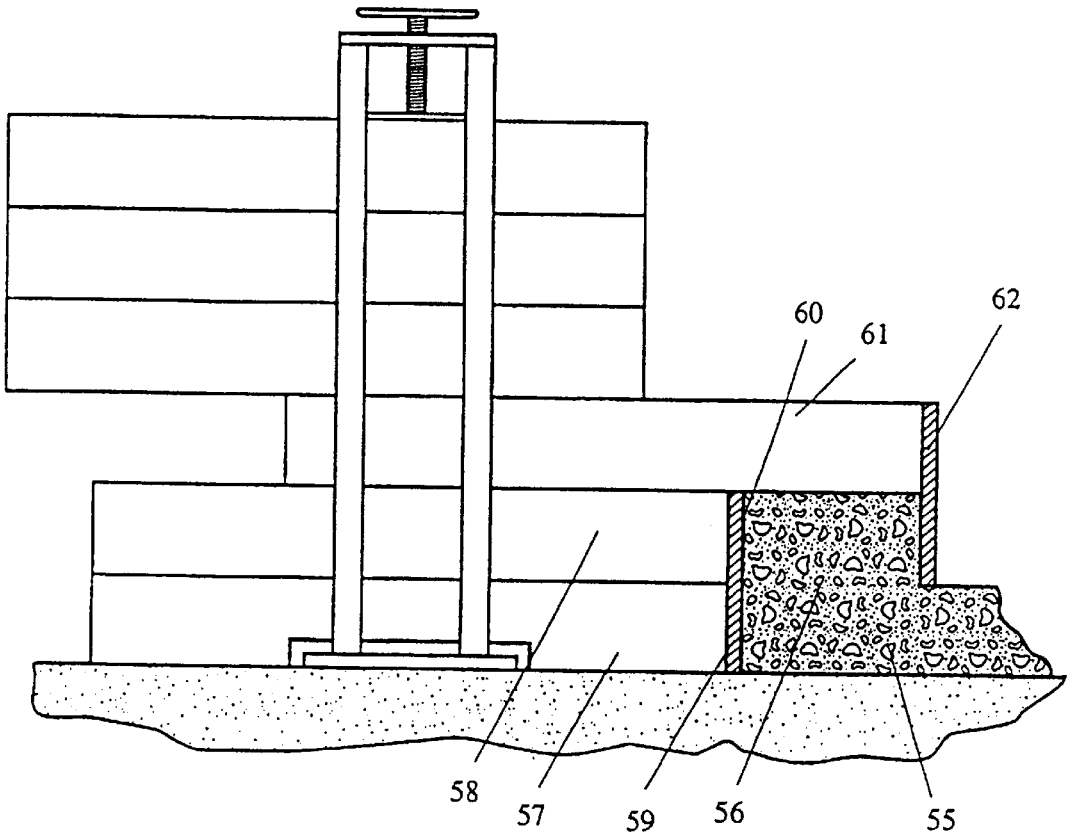
FIG. 11 is a sketch of a panel with a lip being formed.
Figure 12:
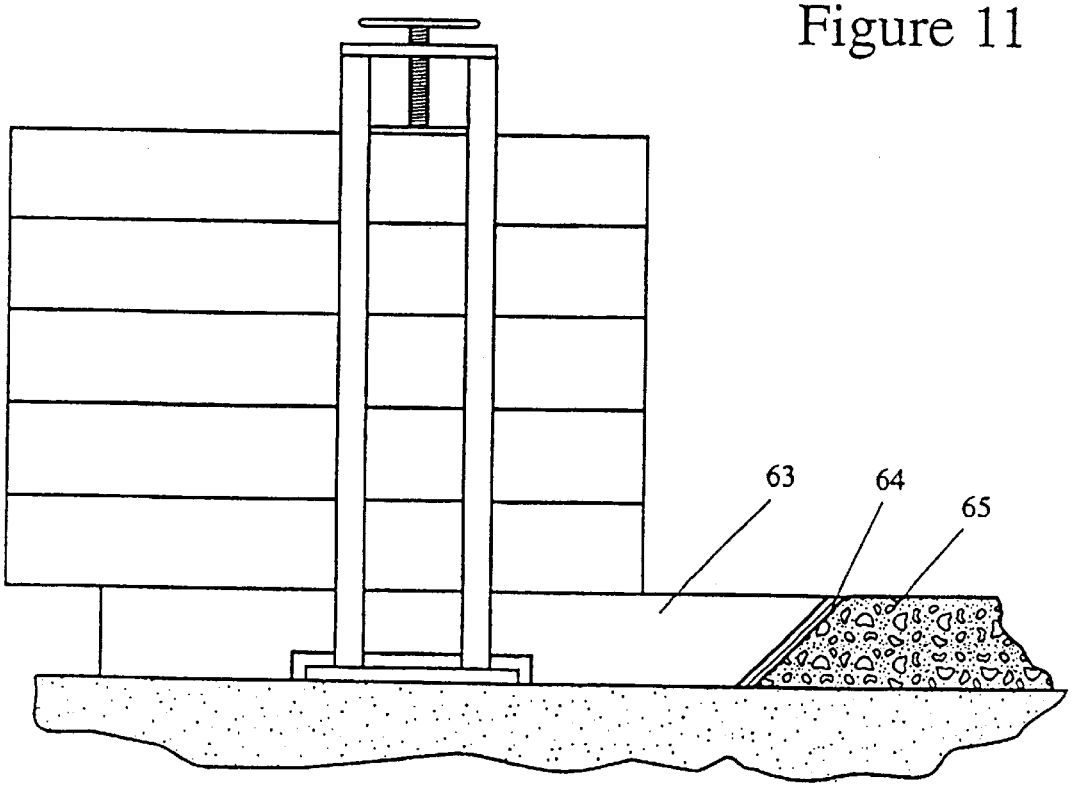
FIG. 12 is a sketch of a floor with sloping side being formed.

It will be appreciated in FIGS. 11 and 12 the panel is shown in part cross-section.

As illustrated in FIG. 11 a panel (55) can be constructed with a lip (56). Here, sliding risers (57 and 58) support the side-form (59) forming the panel edge (60). Sliding riser (61) supports a side-form (62) which depends below the sliding riser (61) to form the panel lip.

Another example is illustrated in FIG. 12 where the sliding riser (63) supports a side-form at a sloping angle to form a ramp (64) to structure (65).

Figure 13:
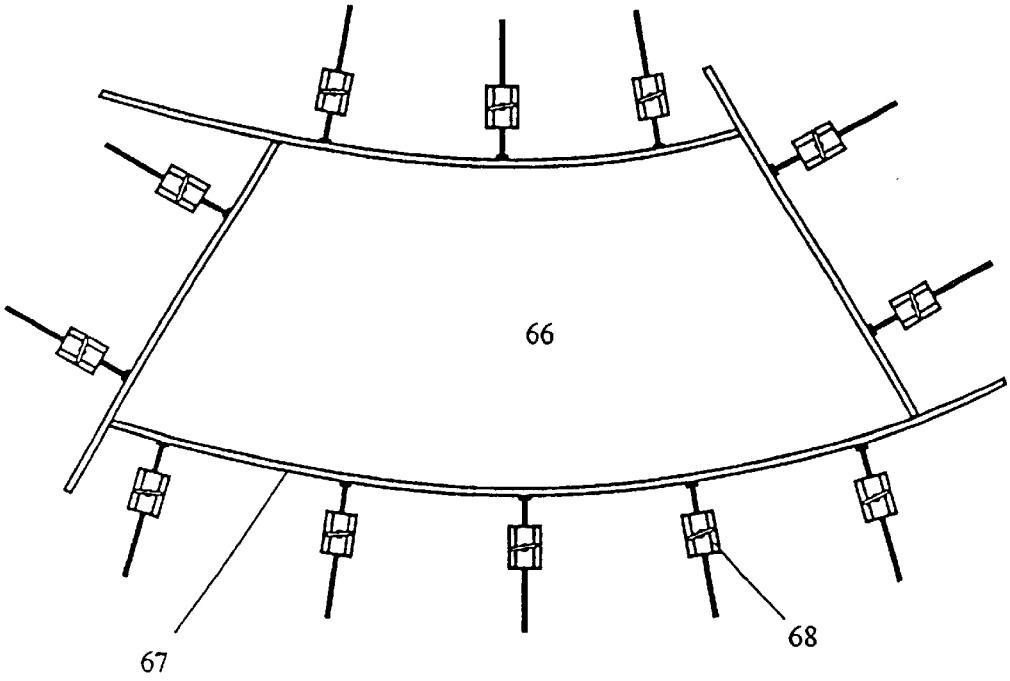
FIG. 13 is a sketch of a plan view of a curved raised structure being formed.

It will be appreciated that the form-work for other structures can be readily arranged using the principles disclosed herein. For example, stairs or step can be formed as a result of the upper sliding risers extending further from the set-back buttress. Also, complex structure profiles, such as concave or convex or over hung wall sides, can be made by differing sliding risers extending differing distances and all supporting a suitable side-form. Further, construction of form-work for curved structures can be readily made by suitable placement of the set-back buttresses and use of a suitable side-form. This is illustrated in FIG. 13 where the construction (66) has form-work (67) about it supported by set-back buttresses one being shown as (68).

It will also be appreciated that the main tools required are a drilling machine to drill holes for masonry anchors, suitable spanner or socket and a screw driver. Unless odd sized panels are being made there is no need for nails or saws so reducing the previously mentioned problems associated with timber form-work.

Figure 15:
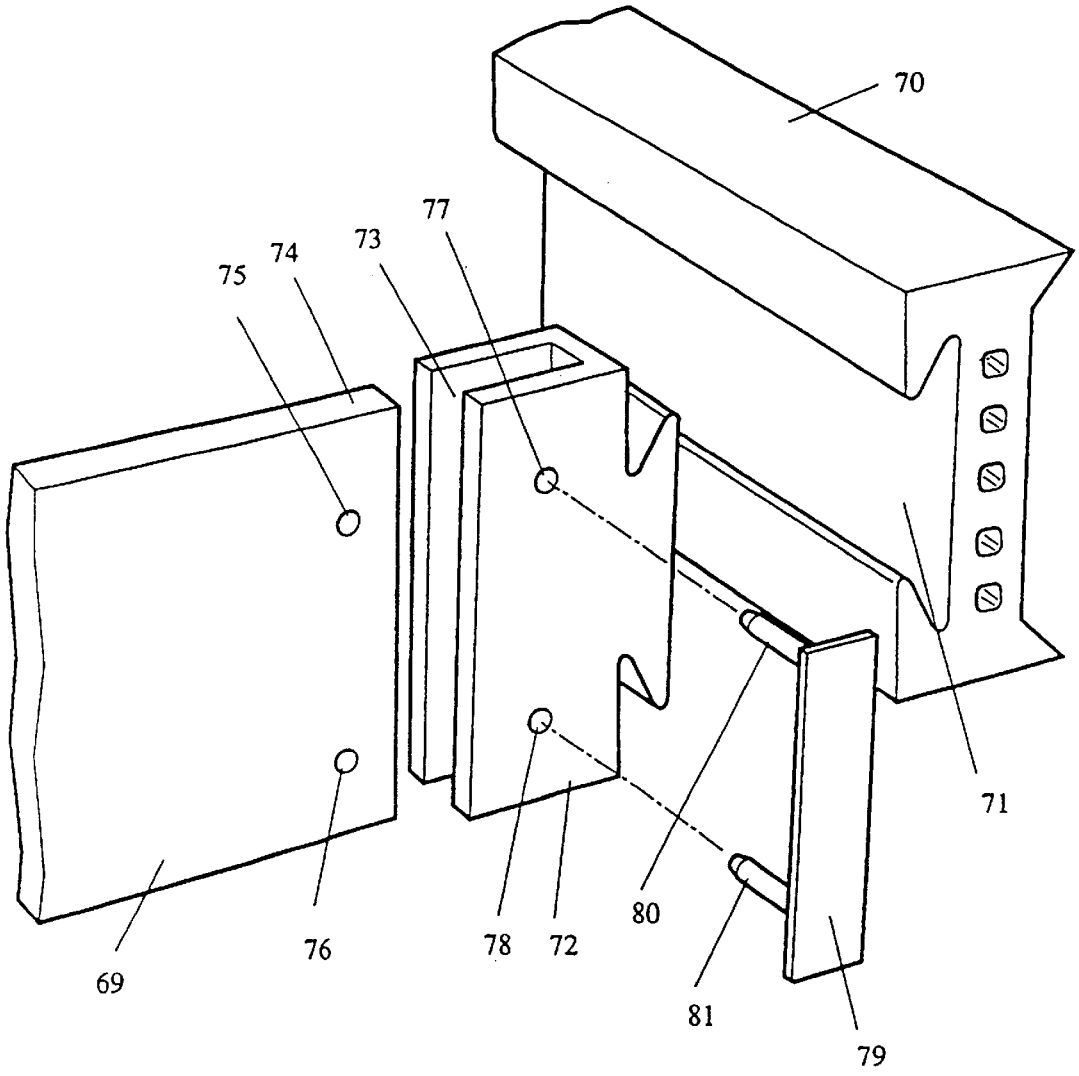
FIG. 15 is a sketch of one means of joining a side-form to a sliding riser.
Figure 18:
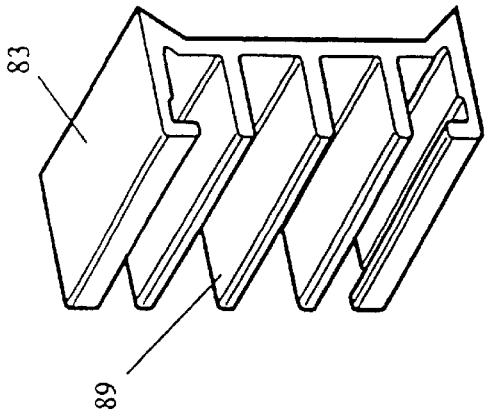
FIG. 18 is a sketch of one form of side-form.
Figure 19:
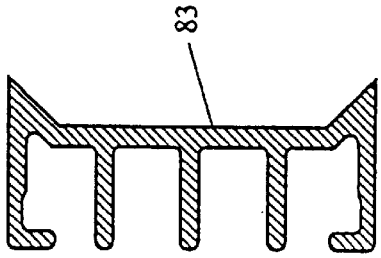
FIG. 19 is a cross sectional view of the side-form of FIG. 18.

In FIG. 15 a different manner of attaching a sliding riser (69) to a side-form (70) is illustrated. Here the side-form has a dove-tail channel (71) in its rear face. Slidable into this channel is joiner (72) which has a vertical slot (73) to receive end (74) of the sliding riser. Within the sliding riser and the joiner are holes (75, 76, 77 and 78) which when the sliding riser and joiner are correctly positioned align. A lock (79) having two spaced pins (80 and 81) is used to secure the sliding riser to the joiner, the pins being inserted into the aligned holes.

Figure 21:
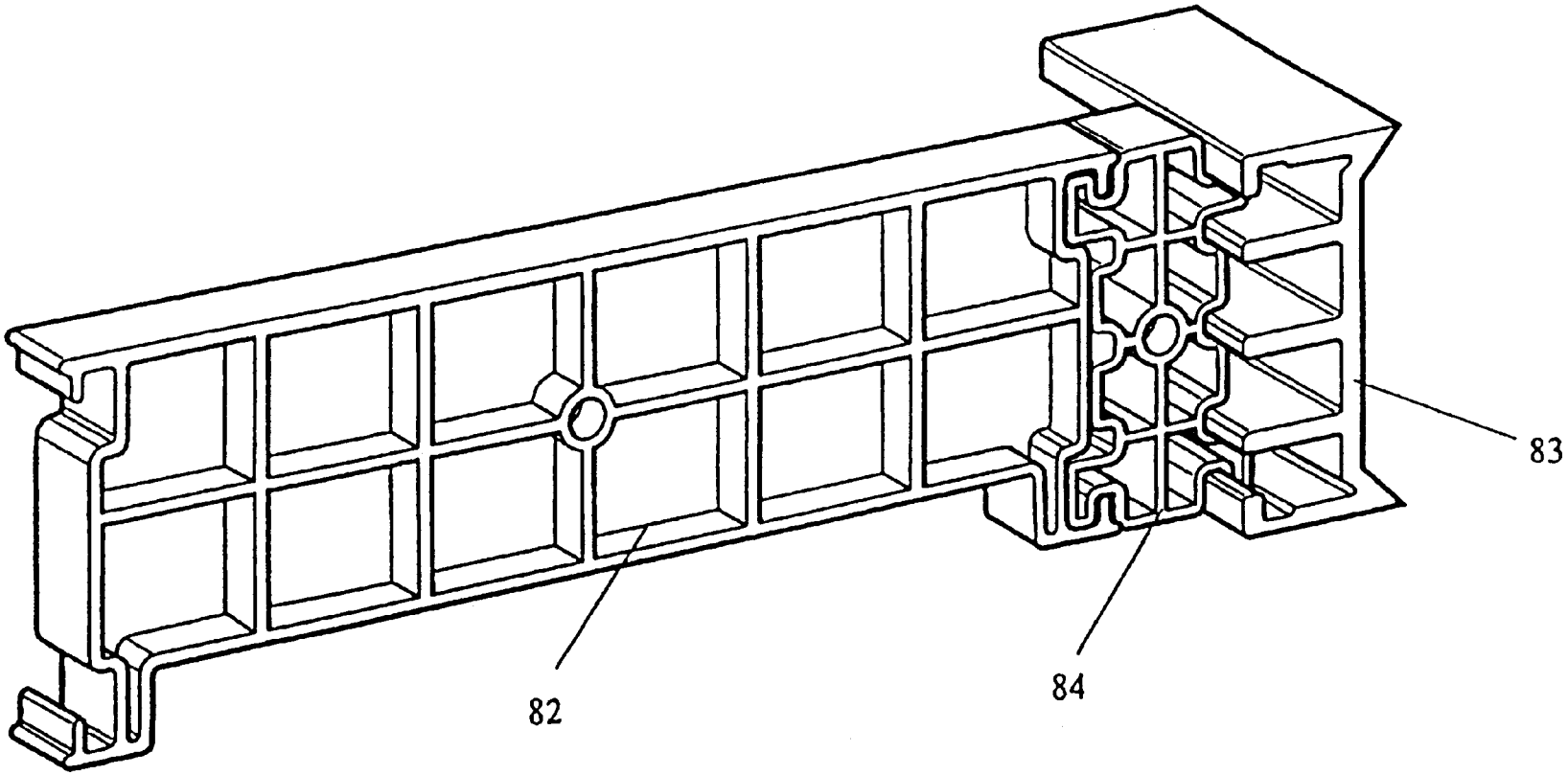
FIG. 21 is a sketch of sliding riser of FIG. 16, a joiner of FIG. 17 and side-form or FIG. 18 assembled.

In FIGS. 16 to 19 and 21 are illustrated a sliding risers (82), a side-form (83) and a joiner (84) all manufactured from extruded polypropylene copolymer plastics. The sliding riser has two female (85 and 86) ends. The ends (87 and 88) of the joiner may be slid into the female ends thereby two sliding risers of the type illustrated in FIG. 16 can be joined. In this manner the sliding risers can be manufactured of a standard length and longer sliding risers as needed for a particular application are made up by joining a number of these standard length sliding risers. Further, the joiner can also be side into the channel (89) at the rear of the side-form. In this manner the joiner can be used to join the sliding riser to the side-form (as illustrated in FIG. 21) and also to join together standard length sliding risers to form longer sliding risers.

Figure 16:
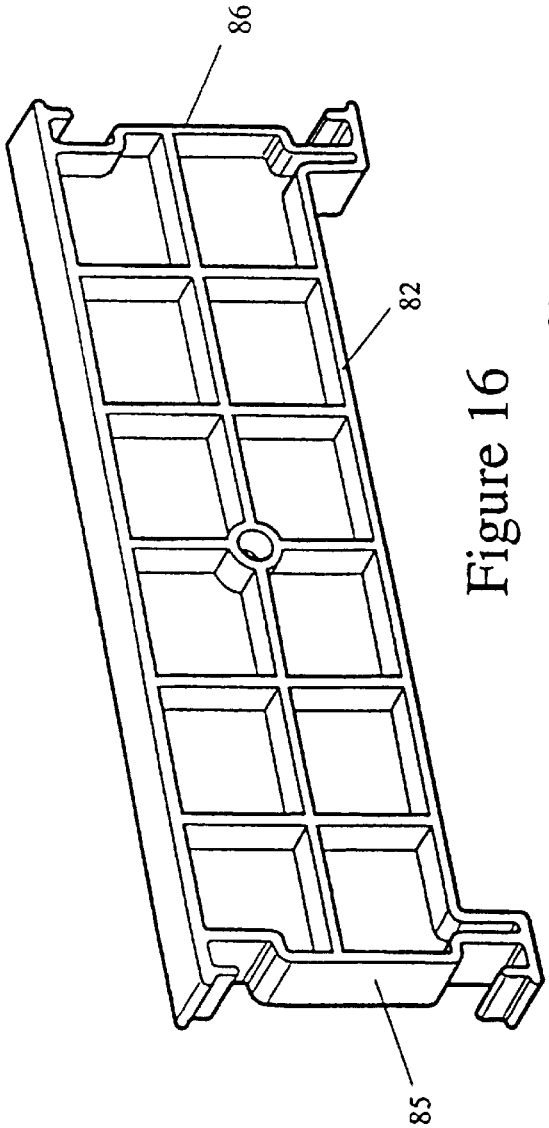
FIG. 16 is a sketch of one form of sliding riser.
Figure 17:
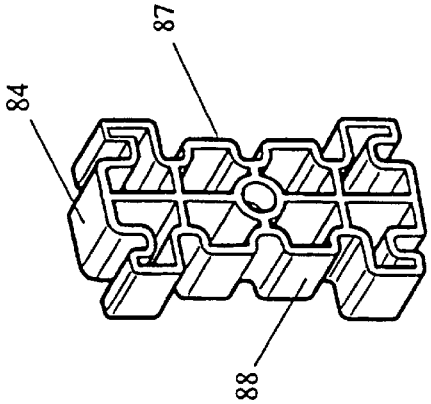
FIG. 17 is a sketch of a joiner for joining a side-form to a sliding riser and for joining two sliding risers of the type illustrated in FIG. 16 together to form longer sliding risers.
Figure 20:
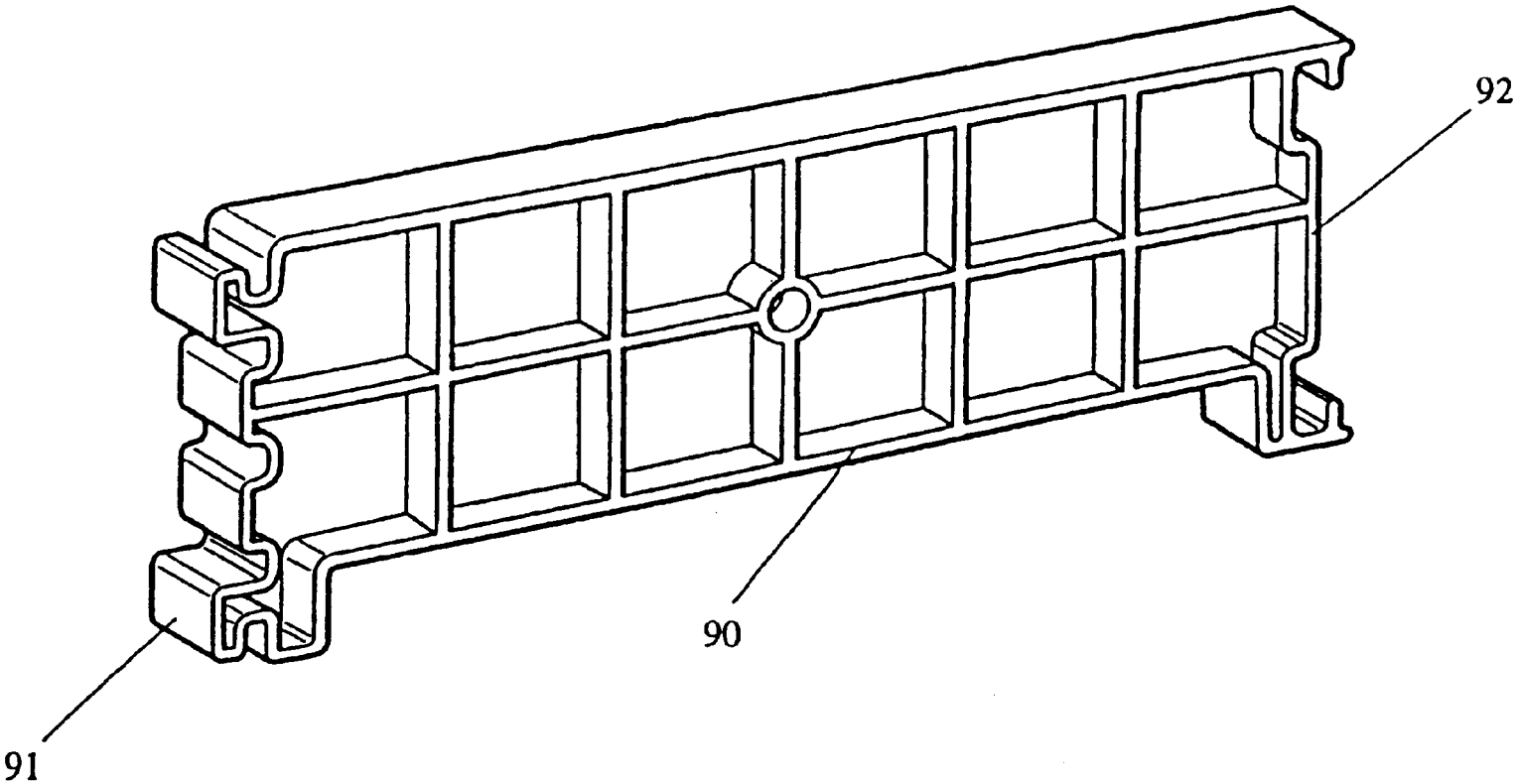
FIG. 20 is a sketch of another sliding riser.

The sliding riser (90) illustrated in FIG. 20 is similar to that illustrated in FIG. 16. The difference is that this sliding riser has a male (91) and a female end (92). The female end is the same as ends (85 and 86) discussed earlier and the male end is the same as ends (87 and 88). In this manner sliding risers of this type and standard length can be joined together. Two sliding risers are brought largest side face to largest side face with the male end over lapping the female end. Then one sliding riser is moved towards the other to insert the male end into the female end. For sliding risers of this type the just mentioned joiner is used to connect them to a side-form of the just mentioned type.

It will also be appreciated that while concrete has been used to illustrate the invention other curable non solid materials can be molded with the invention.

It will be appreciated that this disclosure is not intended to limit the invention to preferred embodiments or details thereof. It is intended to give an overview of the invention as conceived the details of which, at time of writing, are still being investigated. Further, a skilled addressee will appreciate the differing structure types and forms that can be provided for.

What is claimed is:

1. A form-work support arrangement which enables concrete panels to be molded horizontally one on top of the other comprising a side-form, a sliding riser that supports the side-form at a form-work location, the sliding riser being slidable in a first plane, a set-back buttress for supporting the sliding riser for sliding movement in the first plane, the set-back buttress being fixed to a work-site surface at a position set back from the form-work location, and said sliding riser being slidable in a first plane between a first position in which it laterally supports the side-form and a second position in which it does not support the side-form and lies clear of the side-form so as to provide substantially unobstructed access to the form-work location.

2. A form-work support arrangement as in claim 1 wherein the set-back buttress substantially resists movement of the sliding riser in planes other than the first plane.

3. A form-work support arrangement as in claim 1 including a plurality of independent sliding risers, and the set-back buttress supporting the plurality of independent sliding risers one above the other.

4. A form-work arrangement including:

a plurality of sliding risers for supporting a side-form at a form-work location, the sliding risers being slidable in a first plane;

at least one set-back buttress comprising:

an anchor plate fixable to a work-site surface, the anchor plate for supporting the set-back buttress on the work-site surface at a position set back from the form-work location;

a riser support frame projecting upwardly from the anchor plate when the anchor plate is bearing against the work-site surface, the riser support frame supporting at least one of the sliding risers for slidable movement transverse to and from the work-location in the first plane between a first position in which the sliding riser laterally supports the side-form and a second position in which the sliding riser does not support the side-form and lies clear of the side-form so as to provide substantially unobstructed access to the form-work location, and the riser support frame substantially resisting movement of the sliding risers in planes other than the first plane; and locking means for selectively securing the sliding riser or risers in a fixed configuration with respect to the riser support frame and to selectively permit the sliding riser or risers to be moved relative to the riser support frame; and, thereby each sliding riser can be moved and secured to support the side-form at the form-work location and released and moved away from the side-form.

5. An arrangement as in claim 4 including at least one side-form for placement at the form-work location to form form-work supported in place by sliding risers secured by the locking means.

6. An arrangement as in claim 5 including a plurality of side-forms, each side-form being respectively transversely securable to an end of at least one of the sliding risers.

7. An arrangement as in claim 5 wherein the side-form includes a removable form facing part affixed to the side-form on a side of the side-form opposite to the set-back buttress.

8. An arrangement as in claim 4, including a plurality of set-back buttresses and wherein the sliding risers are vertically disposed on edge, one on top of the other.

9. An arrangement as in claim 6 including a plurality of set-back buttresses and wherein at least one of the side-forms is supported by a number of the sliding risers each supported by a respective set-back buttress.

10. An arrangement as in claim 4 wherein the set-back buttress includes means acting between the anchor plate and the work-site surface for substantially leveling the anchor plate.

11. An arrangement as in claim 4 wherein the set-back buttress includes means acting between the set-back buttress and one of the sliding risers to substantially level and adjust the relative position of the sliding riser with respect to the set-back buttress for plumbing and leveling the sliding riser relative to a same horizontal plane.

12. An arrangement as in claim 5 wherein the side-form has two integral fillets upon a face distal the set-back buttress, each fillet being along the length of the side-form and either side and aligned with the edge of its width.

13. An arrangement as in claim 12 wherein the side-form has an end of configuration shaped to permit the side-form to be butted against another side-form to thereby produce a continuous form-work.

14. A form-work arrangement for an on-site molding of concrete construction panels, the arrangement including a plurality of sliding risers slidably movable in a first plane, a plurality of side-forms, and a plurality of set-back buttresses, each set-back buttress comprising:

an anchor plate fixable to a work-site surface, the anchor plate for supporting the set-back buttress on the work site surface at a position set back from the form-work location;

a riser support frame projecting upwardly from the anchor plate when the anchor plate is bearing against the work-site surface, the riser support frame supporting one or more of the sliding risers for slidable movement transverse to and from the form-work location in the first plane between a first position in which the sliding riser laterally supports the side-form and a second position where the sliding riser does not support the side-form and lies clear of the side-form so as to provide substantially unobstructed access to the form-work location, and the riser support frame substantially resisting movement of the sliding risers in planes other than the first plane;

locking means for selectively securing the sliding riser or risers in a fixed configuration with respect to said riser support frame; and, each side-form being respectively transversely securable to an end of at least one of the sliding risers, and supportable in position of form-work.

15. A form-work arrangement for an on-site molding of a multiple layer stack of separate concrete construction panels wherein a plurality of construction panels are molded one on top of another, the arrangement including a plurality of sliding risers slidably movable in a first plane, a plurality of side-forms, and a plurality of set-back buttresses, each set-back buttress comprising:

an anchor plate fixable to a work-site surface, the anchor plate for supporting the set-back buttress on the work site surface at a position set back from the form-work location;

a riser support frame projecting upwardly from the anchor plate when the anchor plate is bearing against the work-site surface, the riser support frame comprising means for supporting one or more of the sliding risers for slidable movement transverse to and from the form-work location in the first plane, and the riser support frame substantially resisting movement of the sliding risers in planes other than the first plane;

locking means for selectively securing the sliding riser or risers in a fixed configuration with respect to the riser support frame;

each side-form being respectively transversely securable to an end of at least one of the sliding risers, and supportable in position of form-work; the arrangement being one wherein for each layer the sliding risers and the side-forms each have a vertical dimension substantially the same as the thickness of a panel to be molded at that layer, and that the sliding risers of subsequent layers of the set-back buttress are supported within the riser frame by the sliding risers of preceding layers.

16. An arrangement as in claim 15 wherein the side-forms for each layer are abuttable firstly end to end and secondly end to form work face whereby a continuous form work periphery can be made using the side-forms.

17. A method of making structures from cureable non solid material including the steps of:

i. marking out the structure on a work-site surface where from-work is to be constructed;

ii. marking out off-set buttress locations at predetermined centers and distances from the marked out structure;

iii. securing a plurality of off-set buttresses to the work-site surface such that a sliding riser supported by an off-set buttress can move to and from the marked out form-work location;

iv. leveling and plumbing the off-set buttress;

v. inserting at least one sliding riser into each off-set buttress;

vi. covering the work-site surface upon which the structure is to be formed with release means to substantially prevent adherence of the cureable non solid material to the work-site surface;

vii. placing side-forms along the marked sides of the structure;

viii. sliding the sliding risers from the off-set buttresses to the side-forms and affixing the side-forms to the sliding risers;

ix. operating locking means to lock the sliding risers in place relative to the off-set buttress;

x. installing reinforcing material within the form-work;

xi. manufacturing the structure;

xii. once the structure has sufficiently cured, releasing the locking means;

xiii. unfixing the side-forms from the sliding risers and sliding back the sliding riser away from the structure; and, xiv. pulling away the side-form from the structure.

18. A method as in claim 17 for on-site manufacture of construction panels including the further steps of:

i. setting up means to determine a level plane and adjusting the sliding risers so that the sliding risers are all level and within the same plane;

ii. placing side-forms along the marked sides of the structure each with an end abutting a form-work face of an adjoining side-form;

iii. once the last poured panel has cured sufficiently, unfixing the side-forms from the affixed sliding risers and sliding back those sliding riser away from the panel;

iv. pulling away the side-form from the panel;

v. reforming the side-form above the last poured panel;

vi. sliding to the side-forms sliding risers and fixing the side-forms to the sliding risers;

vii. covering the uppermost surface of the last poured panel with release means to substantially prevent adherence of the cureable non solid material to the uppermost surface; and, viii. repeating the process until a total stack of panels is formed.

19. A side-form arrangement for building form-work used for molding a concrete construction panel directly on top of a previously poured panel wherein the upper panel to be molded has a size smaller than that of the previously poured panel, said side-form arrangement including:

an elongate side-form having an outer face, and an outwardly opening locking channel extending longitudinally of said outer face, said side-form, when in use, being horizontally supported in a predetermined form-work position on top of said previously poured panel near a perimeter edge thereof, a plurality of horizontally aligned transversely slidable side-form supports arranged to laterally support said side-form, at spaced apart intervals therealong, in its said form-work position, each said side-form support being provided with an engagement member adapted to releasably interlock with said locking channel, while the side-form is in its said horizontally supported form-work position, to in turn releasably interconnect said side-form support and the side-form, wherein each said side-form support is supported for transverse horizontal sliding movement to and from the form-work position, and means for releasably securing said slidable side-form supports against transverse horizontal sliding movement.

20. A side-form arrangement according to claim 19 wherein each of the slidable side-form supports and the side-form have a vertical dimension which is approximately equal to the thickness of the panel being molded.

21. A side-form arrangement according to claim 19 wherein said engagement member is detachable from its associated said transversely slidable side-form support.

* * * * *

UNITED STATES PATENT AND TRADEMARK OFFICE

CERTIFICATE OF CORRECTION

PATENT NO. : 6,247,677 B1
DATED : June 19, 2001
INVENTOR(S) : Vinet, Alexander J. et al.

It is certified that error appears in the above-identified patent and that said Letters Patent is hereby corrected as shown below:

Column 4,
Line 32, after "125 mm" and before the comma, insert -- (5 in) --.
Line 32, after "150 mm", insert -- (6 in.) --.
Line 32, after "175 mm" and before the period, insert -- (7 in) --.

Column 10,
Line 11, delete the second occurrence of "18 mm".

Column 11,
Line 2, "18.2 ft" should be changed to -- 13.12 ft --.
Line 13, "(6)" should be change to -- (6 in) --.

Column 16,
Line 21, change "riser" to -- risers --.

Signed and Sealed this

Eighth Day of October, 2002

*Attest:*

*Attesting Officer*

JAMES E. ROGAN
*Director of the United States Patent and Trademark Office*